US005127823A

United States Patent [19]

Bonner

[11] Patent Number: 5,127,823

[45] Date of Patent: Jul. 7, 1992

[54] CONTROL SYSTEM FOR A GAS FURNACE, CONTROL DEVICE THEREFOR AND METHODS OF MAKING THE SAME

[75] Inventor: Michael R. Bonner, Portage, Mich.

[73] Assignee: Robertshaw Controls Company, Richmond, Va.

[21] Appl. No.: 616,609

[22] Filed: Nov. 21, 1990

[51] Int. Cl.[5] ..... F23Q 9/08

[52] U.S. Cl. ..... 431/46; 431/60; 431/75

[58] Field of Search ..... 431/67, 74, 75, 90, 431/255, 43, 46, 80

[56] References Cited

U.S. PATENT DOCUMENTS 4,455,589 6/1984 Riordan et al. ..... 431/67
4,842,510 6/1989 Grunden et al. ..... 431/90
4,865,539 9/1989 Geary ..... 431/46
4,915,614 4/1990 Geary ..... 431/25
4,978,292 12/1990 Donnelly ..... 431/75

*Primary Examiner*—James C. Yeung
*Attorney, Agent, or Firm*—Candor, Candor & Tassone

[57] ABSTRACT

A control system for a gas furnace, control device therefor and methods of making the same are provided, the system comprising an electrical circuit that has a metal oxide varistor therein that is adapted to interconnect one end of a secondary winding of a transformer to frame ground only after the potential for sparking is reached at an igniter that is interconnected to the other end of the secondary winding and causes the varistor to break over and cause the igniter to spark.

15 Claims, 2 Drawing Sheets

2A
2B
R1 4.7M
R2 79 7W
R3 33
R4 2.2K
R5 39K
R6 4.3K .5W
R7 5.6K
R11
R12 22M
C3 47uF 50V 20%
C5 .068uF 250VDC
C6 100uF
D1 1N4148
D2
D3
D4
D5 1N4148
D8 1N4148
Q1 2N5639
Q2 2N2222A
Q3 MPS-W-01A
Q6 2N2907A
Q7 2N2222A
E1
E2
E4
E5
E6
E7
E8

CONTROL SYSTEM FOR A GAS FURNACE, CONTROL DEVICE THEREFOR AND METHODS OF MAKING THE SAME

BACKGROUND OF THE INVENTION

1. Field of the Invention

This invention relates to a new control system for a gas furnace and to a new control device for such a system as well as to new methods of making such a control system and such a control device.

2. Prior Art Statement

It is known to provide a control system for a gas furnace wherein the system comprises a pilot burner means, a main burner means, and an electrical circuit means, the circuit means comprising an electrically operable pilot gas valve means, an electrically operable main gas valve means, an igniter means for generating sparks to ignite fuel issuing from the pilot burner means, a transformer means operatively associated with the igniter means for generating the sparks therewith, flame sensing means operatively associated with the pilot burner means for sensing flame at the pilot burner means through flame rectification, a thermostatic switch means, and control means operatively associated with all of the means to cause the pilot valve means to issue gas from the pilot burner means and to cause the transformer means to create igniting sparks with the igniter means when the thermostatic switch means determines that the furnace should be in an "on" condition, the control means thereafter causing the main valve means to issue gas from the main burner means and to cause the transformer means to cease generating the sparks when the flame sensing means senses flame at the pilot burner means, the circuit means comprising a frame ground that is also the circuit ground for the circuit means, the transformer means comprising a secondary winding having a first end thereof electrically interconnected to the igniter means and having a second end thereof interconnected to the frame ground. For example, see the control system that uses the control device sold as the SP-715 control device by the Simicon Division of the Robertshaw Controls Company, Holland, Mich. Also, see the U.S. patents to Geary, U.S. Pat. Nos. 4,865,539 and 4,915,614 for similar systems.

It is also known to interconnect the second end of the secondary winding of the transformer means of such a system to a frame ground with a gas breakover device and separate the frame ground from the circuit ground with a resistor so that two separate grounds are provided for the system. In this manner, the same probe for the igniter means can be used as the flame sense probe.

SUMMARY OF THE INVENTION

It is one feature of this invention to provide a new control system for a gas furnace wherein proper sparking is provided for the igniter means thereof and the flame sense network is protected from damage even though the spark electrode of the system is also utilized as the flame sense means therefor.

In particular, it was found according to the teachings of this invention that a metal oxide varistor can be utilized as a breakover device to allow proper sparking while protecting the flame sense network from damage.

For example, one embodiment of this invention comprises a control system for a gas furnace, the system comprising a pilot burner means, a main burner means, and an electrical circuit means, the circuit means comprising electrically operable pilot gas valve means, an electrically operable main gas valve means, an igniter means for generating sparks to ignite fuel issuing from the pilot burner means, a transformer means operatively associated with the igniter means for generating the spark therewith, flame sensing means operatively associated with the pilot burner means for sensing flame at the pilot burner means through flame rectification, a thermostatic switch means, and control means operatively associated with all of the means to cause the pilot valve means to issue gas from the pilot burner means and to cause the transformer means to create igniting sparks with the igniter means when the thermostatic switch means determines that the furnace should be in an "on" condition, the control means thereafter causing the main valve means to issue gas from the main burner means and to cause the transformer means to cease generating the sparks when the flame sensing means senses flame at the pilot burner means, the circuit means comprising a frame ground that is also the circuit ground for the circuit means, the transformer means comprising a secondary winding having a first end thereof electrically interconnected to the igniter means and having a second end thereof electrically interconnected to the frame ground, the circuit means comprising a metal oxide varistor that is adapted to interconnect the second end of the secondary winding of the transformer means to the frame ground only after the potential for sparking is reached at the igniter means and causes the varistor to break over and cause the igniter means to spark.

Accordingly, it is an object of this invention to provide a new control system for a gas furnace, the system of this invention having one or more of the novel features of this invention as set forth above or hereinafter shown or described.

Another object of this invention is to provide a new method of making such a control system, the method of this invention having one or more of the novel features of this invention as set forth above or hereinafter shown or described.

Another object of this invention is to provide a new control device for such a system, the control device of this invention having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIGS. 2A and 2B are respectively parts of the electrical circuit means that comprise the control device of this invention when FIGS. 2A and 2B are placed together at the dash-dotted lines thereof in the manner illustrated in FIG. 1.

DESCRIPTION OF THE PREFERRED EMBODIMENT

Figures 1, 2A, 3, 4:
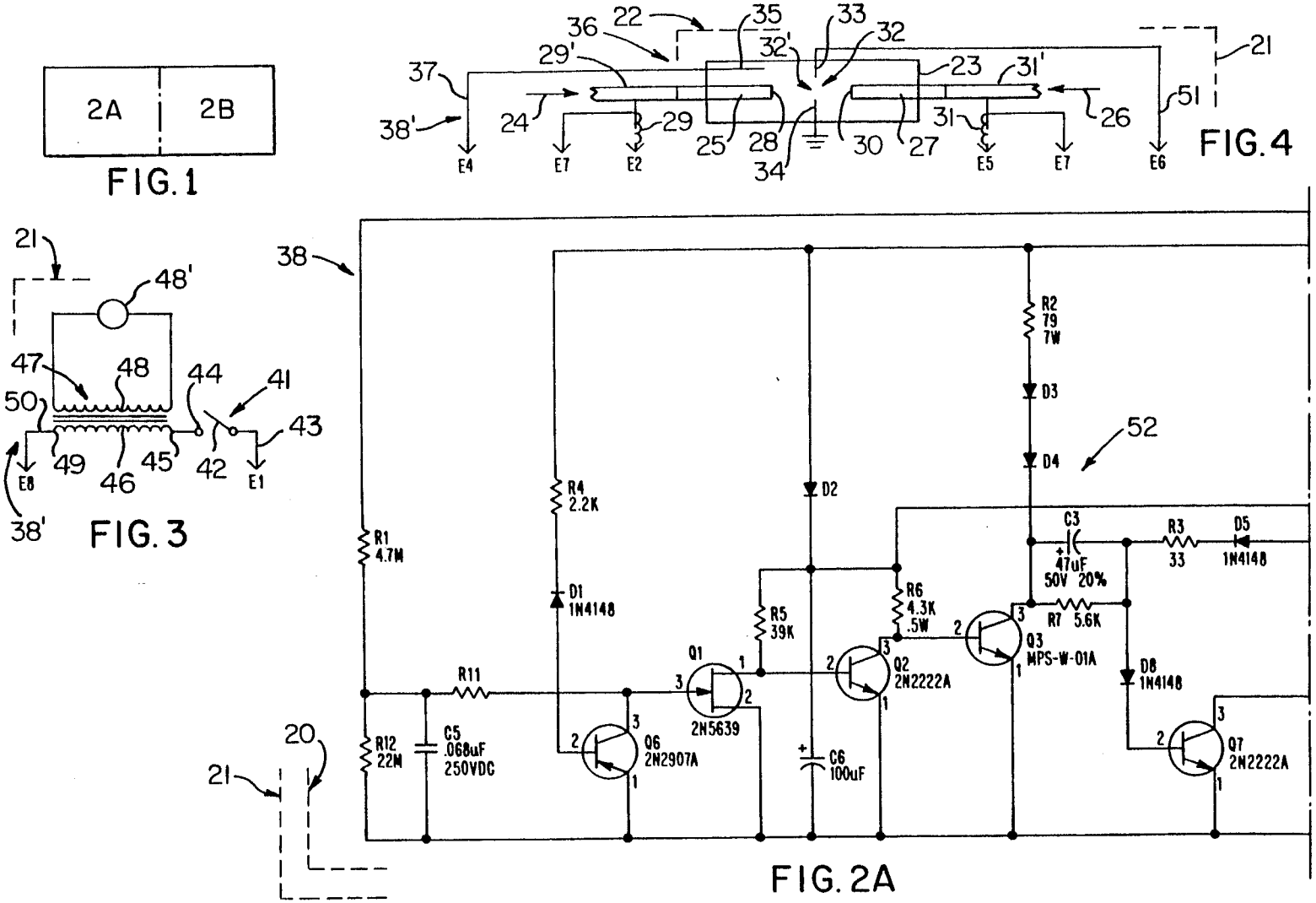
FIG. 1 is a schematic view illustrating how
FIGS. 2A and 2B are to be placed together at the dash-dotted lines thereof to illustrate the control device of this invention.
FIG. 3 is part of the control system of this invention and illustrates how the power source and thermostatic switch means of the system is to be interconnected to certain terminals of the part of the control device of FIG. 2B.
FIG. 4 is a view similar to FIG. 3 and illustrates other parts of the control system of this invention and how the same is to be interconnected to certain of the other terminals of the part of the control device of FIG. 2B.

While the various features of this invention are hereinafter illustrated and described as being particularly adapted to provide a control means to be utilized with a particular control system, such as the control system of the aforementioned U.S. patent to Geary, U.S. Pat. No. 4,915,614, it is to be understood that the various features of this invention can be utilized singly or in various combinations thereof to provide control means to be utilized with other control systems as desired.

Therefore, this invention is not to be limited to only the embodiment illustrated in the drawings, because the drawings are merely utilized to illustrate one of the wide variety of uses of this invention.

Figure 2B:
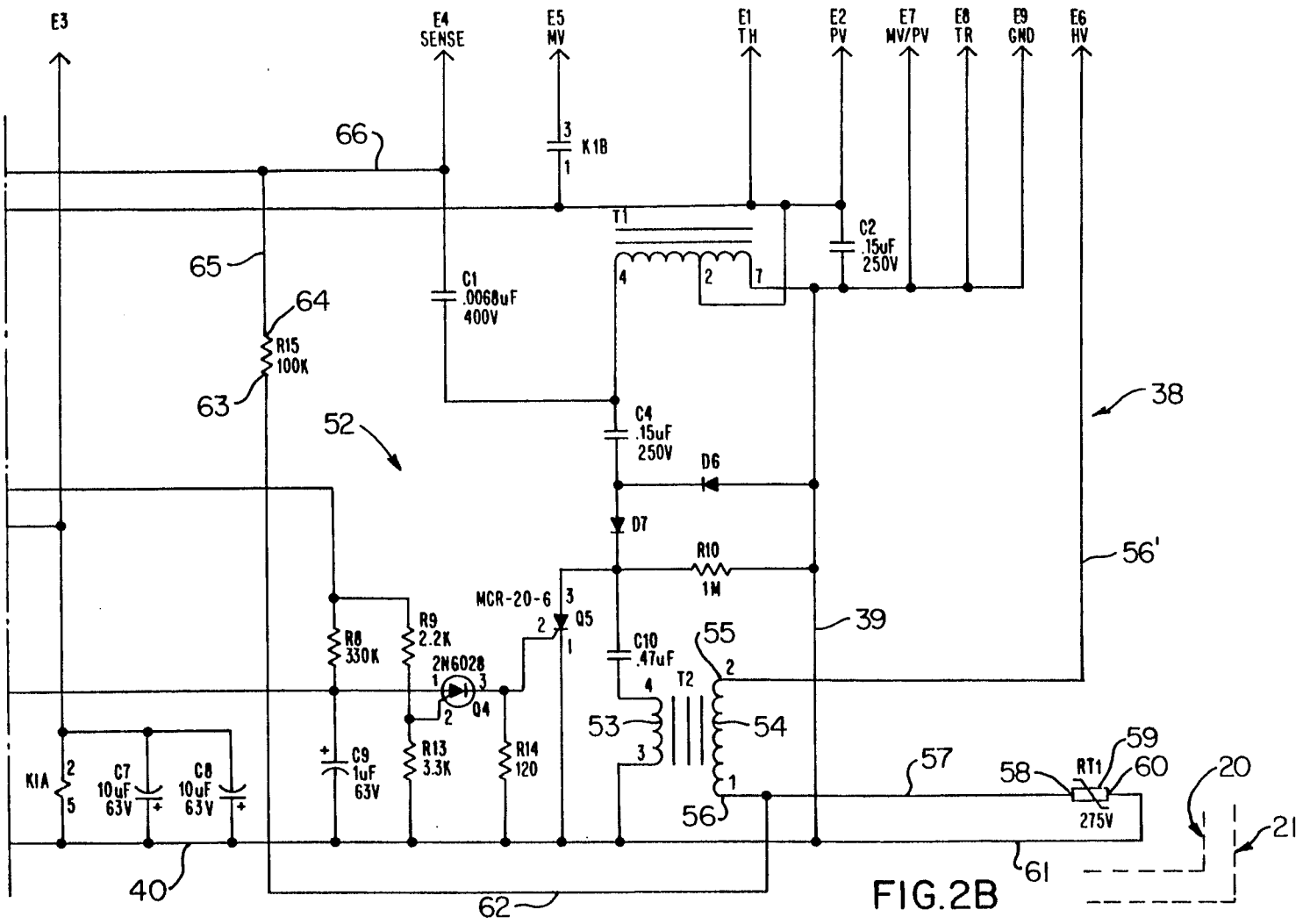

Referring now to FIGS. 2A and 2B, the new control device of this invention is generally indicated by the reference numeral 20 and is being utilized in a control system that is generally indicated by the reference numeral 21 in FIG. 2A, FIG. 2B, FIG. 3 and FIG. 4 for controlling a gas furnace that is generally indicated by the reference numeral 22 in FIG. 4 in a manner hereinafter set forth.

The furnace 22 has a combustion chamber 23 adapted to be supplied with pilot gas from a source 24 thereof through a pilot burner means 25 and to be supplied with main gas from a supply 26 thereof through a main burner means 27 thereof, the pilot gas being adapted to issue out of an outlet end 28 of the pilot burner means 25 when an electrically operated structure, such as a coil 29 of a pilot gas valve means 29', is energized in a manner well known in the art and the main gas being adapted to issue out of an outlet end 30 of the main burner means 27 when an electrically operated structure, such as a coil means 31 of a main gas valve means 31', is energized all in a manner conventional in the art. For example, see the aforementioned U.S. patents to Geary, U.S. Pat. Nos. 4,865,539 and 4,915,614, whereby these two patents are being incorporated into this disclosure by this reference thereto.

The control system 21 includes an electrical spark generating means that is generally indicated by the reference numeral 32 in FIG. 4 and is disposed in the combustion chamber 23 in such a manner that the same is adapted to ignite fuel issuing from the outlet end 28 of the pilot burner means 25 when an electrical current of a certain voltage is pulsed to one electrode 33 of the spark generating means 32 to spark across a spark gap 32' thereof to a grounded electrode 34 all in the manner set forth in the aforementioned U.S. patents to Geary. For example, the ground electrode 34 can be the hood for the pilot burner means 25 as is well known in the art.

The flame of the thus ignited pilot burner means 25 is adapted to ignite fuel subsequently issuing from the outlet end 30 of the main burner means 27. However, before fuel is caused to issue from the main burner means 27, a probe 35 of a flame sense means that is generally indicated by the reference numeral 36 must generate a negative voltage through flame rectification thereof in the manner fully set forth in the aforementioned U.S. patents to Geary, such negative voltage being transmitted by an electrical lead 37 to a flame sense terminal E4 of an electrical circuit means that is generally indicated by the reference numeral 38 in FIGS. 2A and 2B and comprising part of the control device 20 as will be apparent hereinafter. Such circuit means 38 will then cause the main gas valve means 31' to issue fuel out of the main burner means 27 to be ignited by the flame of the pilot burner means 25.

However, the system 21 of this invention can be used without the probe 35 as the igniter electrode 33 can be used as the sense probe as will be apparent hereinafter.

In addition to the terminal E4 of the control device 20, the control device 20 has terminals E1, E2, E3, E5, E6, E7, E8 and E9 with all but the terminals E3 and E9 being interconnected to the structure illustrated in FIGS. 3 and 4 by external electrical circuit means 38' of the system 21 wherein like terminal numbers El, E2, E4, E5, E6, E7, E8 are illustrated.

The terminal E3 of the control device 20 is adapted to be interconnected to a lockout circuit (not shown) and the terminal E9 of the control device is adapted to be interconnected to the frame ground of the furnace 22 or any other appropriate earth ground, in a manner well known in the art.

The frame ground that is interconnected to the terminal E9 of the control device 20 is interconnected by a lead 39 of the circuit means 38 to a circuit ground lead 40 so that the frame ground E9 and the circuit ground 40 for the each other by a resistance as in the previously described system where a gas breakover device is utilized.

As illustrated in FIG. 3, a thermostatic switch means of the system 21 is generally indicated by the reference numeral 41 and has a movable switch blade 42 that is interconnected by a lead 43 of the external circuit means 38' to the terminal El of the control device 20 and is adapted to close against a contact 44 when the thermostatic switch means 41 determines that the furnace 22 should be in an "on" condition wherein the main burner means 27 is heating the combustion chamber 23. The closed switch means 41 interconnects the terminal El to one side 45 of a secondary winding 46 of a power source transformer means 47 that has a primary coil 48 for receiving alternating current therethrough from a source 48' of alternating current, such as the conventional 110/120 volt and 50–60 cycle source provided for houses, buildings and the like that normally utilize gas furnaces and the like. The other side 49 of the secondary winding 46 is interconnected by a lead 50 of the external circuit means 38' to the terminal E8 of the control device 20.

The coil means 29 of the electrically operable pilot gas valve means 29' has its opposed sides respectively interconnected by suitable leads of the external circuit means 38' to the terminals E2 and E7 of the control device 20. Similarly, the opposed sides of the coil means 31 of the electrically operable main gas valve means 31' are respectively interconnected by suitable leads of the external circuit means 38' to the terminals E5 and E7 of the control device 20.

The electrode 33 of the igniter means 32 is interconnected by a lead 51 of the external circuit means 38' to the terminal E6 of the control device 20.

Thus, it can be seen that the external electrical circuit means 38' and the internal electrical circuit means 38 of the control device 20 cooperate together to form the circuit means for the system 21.

The electrical circuit means 38 of the control device 20 has control means therein that is generally indicated by the reference numeral 52 in FIGS. 2A and 2B and unless otherwise specified in the drawings, all resistor values shown are in ohms, 0.25 watt, +/−5%; all capacitor values are 50 V, +/−20% and all diodes are IN4004. Since the various parts of the control means 52 are all well known in the art and all operate in a manner well known in the art for controlling the operation of the furnace 22, only the new parts of the control means 52 will be hereinafter set forth.

As previously stated, the system 21 of this invention can be utilized without the sense probe 35 whereby the igniter probe 33 will act as the sense probe. While this eliminates the cost of the sense probe 35 and its assembly, this requires that a path be provided from the spark electrode 33 to the flame sense network of the control means 52 and this path must provide minimal impedance to the flame sense signal as well as provide suppression of the spark potential to prevent damage to the sensitive flame sense circuit. Such a path is uniquely provided by this invention.

In particular, it can be seen that the control means 52 in FIG. 2B comprises a transformer T2 having a primary coil or winding 53 and a secondary coil or winding 54, the transformer T2 being operatively associated with the igniter means 32 for generating the spark therewith in a manner hereinafter set forth.

The secondary winding 54 of the transformer T2 has one side 55 thereof interconnected by a lead means 56' to the terminal E6 and, thus, to the electrode 33 of the igniter means 32 while the other side 56 of the secondary winding 54 is interconnected by a lead 57 to one side 58 of a 275 volt metal oxide varistor 59 that has its other side 60 interconnected by a lead 61 to the circuit ground 40 and, thus, to the frame ground through the lead 39 and the terminal E9.

In the aforementioned prior known control device SP-715, the side 56 of the secondary winding 54 of the transformer T2 thereof is interconnected directly to the circuit ground lead 40 and the prior known control device does not have the metal oxide varistor 59 of this invention utilized therewith.

In addition, the aforementioned prior known control device SP-715 does not have a lead 62 of this invention that is illustrated in FIG. 2B as being interconnected to the lead 57 intermediate the side 56 of the secondary winding 54 of the transformer T2 and the side 58 of the varistor 59 and being interconnected to one side 63 of a 100 K ohm resistor R15 that has its other side 64 interconnected by a lead 65 to a lead 66 that is interconnected to the sense terminal E4 of the flame sensing means 36 as well as to the flame sense network of the control means 52 as illustrated in the drawings.

Thus, the system 21 of this invention can be used with the flame sense probe 35 or without the flame sense probe 35 as the igniter probe 33 will function as the flame sense probe. In fact if the sense probe 35 is used, the system 21 will automatically utilize the best source of flame sensing either at the probe 35 or at the pilot head 25 with the igniter probe 33 acting as the flame sense probe.

Therefore, it can be seen that the system 21 and the control device 20 of this invention can be made the methods of this invention as previously set forth to operate in a manner now to be described.

When the thermostatic switch means 41 determines that the furnace 22 should be in an "on" condition, such as when the temperature of the space being heated by the furnace falls below the set point temperature of the thermostatic switch means 41, the thermostatic switch means 41 closes the switch blade 42 against the contact 44 whereby the secondary winding 46 of the transformer 47 now supplies a stepped down low voltage AC to the circuit means 38 of the control device 20 through the terminals El and E8. Such source of low voltage AC for the circuit means 38 immediately causes the coil 29 of the electrically operable pilot gas valve means 29' to be energized so that fuel will now issue out of the end 28 of the pilot burner means 25. At the same time, the control means 52 of the control device 20 causes the transformer T2 to operate and when the voltage in the secondary winding 54 of the transformer T2 builds up sufficiently for creating a spark across the gap 32' between the electrodes 33 and 34 of the igniter means 32, the varistor 59 breaks over and interconnects the leads 61 and 57 together so that a spark occurs across the gap 32' between the electrodes 33 and 34 to ignite the fuel issuing out of the end 28 of the pilot burner means 25. The inherent resistance and capacitance of the varistor 59 is such that it dissipates the energy of the spark at the igniter means 32 so as to limit ground potential variation and thus permits the frame ground E9 to be the same ground as the circuit ground 40. Between sparks at the igniter means 32, the varistor 59 appears, for all intents and purposes, as an open circuit allowing a direct path to the pilot burner means 25 where a flame can be detected by the electrode 33 for "local" sense of the pilot flame. Thus, it can be seen that the varistor 59 provides a "break over function" to allow proper sparking while protecting the flame sense network of the control means 52 from damage, the varistor 59 acting as both devices with the resistor R15 acting as a current limiting resistor.

In particular, the impact of the spark signal or voltage on the flame sense network of the control means 52 is minimized through the use of the resistor R15, that leads to ground through the series arrangement of the capacitors C1 and C4 and the diode D6 as the spark signal is negative and is shunted by the diode D6. Thus, the rest of the control means 52 is protected from spark voltage through the use of R15, C1, C4 and D6 that leads to ground.

Each time the transformer T2 causes a sparking potential, the varistor 59 breaks over to permit a spark to occur across the electrodes 33 and 34. Once the sparking causes the issuing fuel from the pilot burner means 25 to be ignited, the flame sense probe 35, if used, or the electrode 33 senses the presence of such flame and through the negative voltage created by flame rectification, the control means 52 of the circuit means 38 causes a coil means K1A, FIG. 2B, to be energized to close the relay contacts K1B of FIG. 2B to energize the coil 31 of the main gas valve means 31' so that fuel can issue out of the outlet end 30 of the main burner means 27 to be ignited by the flame of the pilot burner means 25 in a manner well known in the art, the circuit means 52 when sensing a flame at the pilot burner means 25 also causing the transformer T2 to cease the sparking also in a manner well known in the art.

For example, the signal of flame presence by the probe 35 is connected by the terminal E4 to the lead 66 of the circuit means 38 that leads to the flame sense network of the control means 52. In contrast, the signal of flame presence by the electrode 33 is connected by the terminal E6, the secondary winding 54 of the transformer T2, the lead 52, resistor R15 and lead 65 to the lead 66 of the circuit means 38 that leads to the flame sense network of the control means 52. Therefore, it can be seen that when the probe 35 is utilized, two paths for flame signal are provided respectively at terminals E4 and E6 and if the probe 35 is not utilized, then terminal E4 is not used and the flame signal is provided by the electrode 33 at the terminal E6.

Thus, the main burner means 27 continues to have fuel issuing from the end 30 thereof until the thermostatic switch means 41 determines that sufficient heat has been produced by the furnace 23 to satisfy the setting of the thermostatic switch means 41 whereby the thermostatic switch means 41 opens the switch blade 42 away from the contact 44 to disconnect the power source from the circuit means 38 so that the circuit means 38 deenergizes the coil means 29 and 31 so that the pilot burner means 25 and the main burner means 27 are turned off until the next time that the thermostatic switch means 41 determines that the furnace 22 should be in an "on" condition thereof and closes the switch blade means 42 to cause the furnace 22 to operate in the manner previously set forth.

Therefore, it can be seen that the system 21 is an intermittent pilot igniter system that allows local sensing of flame through the use of the pilot head itself, if desired. If the probe 35 is utilized, the system 21 will automatically utilize the best source of flame sense, either at the probe 35 or at the pilot head 25 with the electrode 33 acting as the flame sense probe.

Accordingly, the control device 20 of this invention can be used with systems that have a flame sense probe separate from the igniter probe or with systems that use only the igniter probe for both ignition purposes and flame sense purposes.

Therefore, it can be seen that this invention not only provides a new system for a gas furnace and a new control device for such a system, but also this invention provides new methods of making such a system and such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control system for a gas furnace, said system comprising a pilot burner means, a main burner means, and an electrical circuit means, said circuit means comprising an electrically operable pilot gas valve means, an electrically operable main gas valve means, an igniter means for generating sparks to ignite fuel issuing from said pilot burner means, a transformer means operatively associated with said igniter means for generating said sparks therewith, flame sensing means operatively associated with said pilot burner means through flame rectification, a thermostatic switch means, and control means operatively associated with all of the said means to cause said pilot valve means to issue gas from said pilot burner means and to cause said transformer means to create igniting sparks with said igniter means when said thermostatic switch means determines that said furnace should be in an "on" condition, said control means thereafter causing said main valve means to issue gas from said main burner means and to cause said transformer means to cease generating said sparks when said flame sensing means senses flame at said pilot burner means, said circuit means comprising a frame ground that is also the circuit ground for said circuit means, said transformer means comprising a secondary winding having a first end thereof electrically interconnected to said igniter means and having a second end thereof electrically interconnected to said frame ground, the improvement wherein said circuit means comprises a metal oxide varistor that is in series with said secondary winding of said transformer and that is disposed between said second end of said secondary winding of said transformer and said frame ground so as to be adapted to interconnect said second end of said secondary winding of said transformer means to said frame ground only after the potential for sparking is reached at said igniter means and caused said varistor to break over and cause said igniter means to spark.

2. A control system as set forth in claim 1 wherein said varistor is a 275 volt metal oxide varistor.

3. A control system as set forth in claim 1 wherein said circuit means comprises a resistor having a first end thereof electrically interconnected to said second end of said secondary winding of said transformer means intermediate said second end and said varistor and having a second end thereof electrically interconnected to said control means.

4. A control system as set forth in claim 3 wherein said resistor comprises a 100 K ohm resistor.

5. A control system as set forth in claim 3 wherein said second end of said resistor is also electrically interconnected to said flame sensing means.

6. A control means as set forth in claim 5 wherein said igniter means comprises a first electrode probe, said flame sensing means comprising a second electrode probe.

7. A control system as set forth in claim 4 wherein said flame sensing means also comprises said igniter means.

8. A control system as set forth in claim 7 wherein said igniter means comprises an electrode probe, said flame sensing means also comprising said electrode probe.

9. In a control device for a control system for a gas furnace, said system comprising a pilot burner means, a main burner means, an electrically operable pilot gas valve means, an electrically operable main gas valve system, an igniter means for generating sparks to ignite fuel issuing from said pilot burner means, flame sensing means operatively associated with said pilot burner means for sensing flame at said pilot burner means through flame rectification, and a thermostatic switch means, said control device comprising an electrical circuit means comprising a transformer means operatively associated with said igniter means for generating said sparks therewith and control means adapted to be operatively associated with all of said means to cause said pilot valve means to issue gas from said pilot burner means and to cause said transformer means to create igniting sparks with said igniter means when said thermostatic switch means determines that said furnace should be in an "on" condition, said control means thereafter being adapted to cause said main valve means to issue gas from said main burner means and to cause said transformer means to cease generating said sparks when said flame sensing means senses flame at said pilot burner means, said circuit means comprising means adapted to be interconnected to a frame ground that will also be the circuit ground for said circuit means, said transformer means comprising a secondary winding having a first end thereof adapted to be electrically interconnected to said igniter means and having a second end thereof electrically interconnected to said means adapted to be interconnected to said frame ground, the improvement wherein said circuit means comprises a metal oxide varistor that is in series with said secondary winding of said transformer and that is disposed between said second end of said secondary winding of said transformer and said means adapted to be interconnected to said frame ground so as to be adapted to interconnect said second end of said secondary winding of said transformer means to said means adapted to be interconnected to said frame ground only after the potential for sparking is reached at said igniter means and cause said varistor to break over and cause said igniter means to spark.

10. A control device as set forth in claim 9 wherein said varistor is a 275 volt metal oxide varistor.

11. A control device as set forth in claim 9 wherein said circuit means comprises a resistor having a first end thereof electrically interconnected to said second end of said secondary winding of said transformer means intermediate said second end and said varistor and having a second end thereof electrically interconnected to said control means.

12. A control device as set forth in claim 11 wherein said resistor comprises a 100 K ohm resistor.

13. A control device as set forth in claim 11 wherein said second end of said resistor is also adapted to be interconnected to said flame sensing means.

14. In a method of making a control system for a gas furnace, said system comprising a pilot burner means, a main burner means, and an electrical circuit means, said circuit means comprising an electrically operable pilot gas valve means, an electrically operable main gas valve means, an igniter means for generating sparks to ignite fuel issuing from said pilot burner means, a transformer means operatively associated with said igniter means for generating said sparks therewith, flame sensing means operatively associated with said pilot burner means for sensing flame at said pilot burner means through flame rectification, a thermostatic switch means, and control means operatively associated with all of said means to cause said pilot valve means to issue gas from said pilot burner means and to cause said transformer means to create igniting sparks with said igniter means when said thermostatic switch means determines that said furnace should be in an "on" condition, said control means thereafter causing said main valve means to issue gas from said main burner means and to cause said transformer means to cease generating said sparks when said flame sensing means senses flame at said pilot burner means, said circuit means comprising a frame ground that is also the circuit ground for said circuit means, said transformer means comprising a secondary winding having a first end thereof electrically interconnected to said igniter means and having a second end thereof electrically interconnected to said frame ground, the improvement comprising the step of disposing a metal oxide varistor in said circuit means so that said metal oxide varistor is in series with said secondary winding of said transformer and is disposed between said second end of said secondary winding of said transformer and said frame ground so as to be adapted to interconnect said second end of said secondary winding of said transformer means to said frame ground only after the potential for sparking is reached at said igniter means and caused said varistor to break over and cause said igniter means to spark.

15. In a method of making a control device for a control system for a gas furnace, said system comprising a pilot burner means, a main burner means, an electrically operable pilot gas valve means, an electrically operable main gas valve means, an igniter means for generating sparks to ignite fuel issuing from said pilot burner means, flame sensing means operatively associated with said pilot burner means for sensing flame at said pilot burner means through flame rectification, and a thermostatic switch means, said control device comprising an electrical circuit means comprising a transformer means operatively associated with said igniter means for generating said sparks therewith and control means adapted to be operatively associated with all of said means to cause said pilot valve means to issue gas from said pilot burner means and to cause said transformer means to create igniting sparks with said igniter means when said thermostatic switch means determines that said furnace should be in an "on" condition, said control means thereafter being adapted to cause said main valve means to issue gas from said main burner means and to cause said transformer means to cease generating said sparks when said flame sensing means senses flame at said pilot burner means, said circuit means comprising means adapted to be interconnected to a frame ground that will also be the circuit ground for said circuit means, said transformer means comprising a secondary winding having a first end thereof adapted to be electrically interconnected to said igniter means and having a second end thereof electrically interconnected to said means adapted to be interconnected to said frame ground, the improvement comprising the step of disposing a metal oxide varistor in said circuit means so that said metal oxide varistor is in series with said secondary winding of said transformer and is disposed between said second end of said secondary winding of said transformer and said means adapted to be interconnected to said frame ground so as to be adapted to interconnect said second end of said secondary winding of said transformer means to said means adapted to be interconnected to said frame ground only after the potential for sparking is reached at said igniter means and cause said varistor to break over and cause said igniter means to spark.

* * * * *